US005813958A

United States Patent [19]

Tomita

[11] Patent Number: 5,813,958

[45] Date of Patent: Sep. 29, 1998

[54] ROCKING FOOT EXERCISER (FOOT ROCKER)

[76] Inventor: Hiroaki Tomita, 38-2, Minamiogikubo 2-chome, Tokyo, Japan

[21] Appl. No.: 756,920

[22] Filed: Dec. 2, 1996

[30] Foreign Application Priority Data

Nov. 30, 1995 [JP] Japan ..... 7-336067

[51] Int. Cl.[6] ..... A63B 22/14

[52] U.S. Cl. ..... 482/146; 601/31

[58] Field of Search ..... 402/146, 147, 402/79; 601/84, 85, 86, 87, 27, 31, 34

[56] References Cited

U.S. PATENT DOCUMENTS

| | | | |
|---|---|---|---|
| 478,166 | 7/1892 | Madsen | 482/146 |
| 2,827,894 | 3/1958 | Meyers | 601/31 |
| 4,061,137 | 12/1977 | Sandt | 128/33 |
| 4,290,601 | 9/1981 | Mittelstadt | 482/146 X |
| 4,429,869 | 2/1984 | Eckstein | 482/146 |
| 4,905,994 | 3/1990 | Hartz | 482/146 |
| 5,113,851 | 5/1992 | Gamba | 128/33 |
| 5,256,127 | 10/1993 | Yeh | 482/146 |

FOREIGN PATENT DOCUMENTS

| | | | |
|---|---|---|---|
| 56-5554 | 6/1979 | Japan . | |
| 57-189971 | 11/1982 | Japan . | |
| 58-160037 | 10/1983 | Japan . | |
| 62-172973 | 7/1987 | Japan . | |
| 8-89597 | 4/1996 | Japan . | |
| 961709 | 9/1982 | U.S.S.R. | 482/146 |
| 1428391 | 10/1988 | U.S.S.R. | 482/146 |
| 1584967 | 8/1990 | U.S.S.R. | 482/146 |

*Primary Examiner*—Richard J. Apley
*Assistant Examiner*—William LaMarca
*Attorney, Agent, or Firm*—Nixon & Vanderhye P.C.

[57] ABSTRACT

A rocking foot exerciser enables exercising of the legs by allowing the ankles to be tilted evenly in multiple directions without rotating the body. A rocking plate, which tilts accompanying rotation of a rotating disk 2; is installed on an inclined surface of the rotating disk 2; installing the horizontal surface of said rotating centering member consisting of the combination of a ring-shaped rails and grooved pulleys provided on an upper surface of a hollow stand case is disposed on a surface of the rotating disk. A motor M is mounted in the stand case and rotates the rotating disk. A central portion of the rocking plate is fixed to the upper portion of a universal joint provided upright on the stand case to prevent the rocking plate from rotating.

11 Claims, 10 Drawing Sheets

ROCKING FOOT EXERCISER (FOOT ROCKER)

BACKGROUND OF THE INVENTION

1. Field of the Invention

The present invention relates to a rocking foot exerciser suitable for use by persons requiring rehabilitation of the legs such as persons recovering from illness or the elderly, various persons attending sports clubs and fitness clubs, or persons attending athletic centers and so forth.

2. Description of the Prior Art

Examples of this type of prior art include miniature see-saws and reciprocating horizontal-moving plates for exercising the ankles.

The above-mentioned prior art merely tilted the ankles in the horizontal direction of the body. Thus, there has been until now no device that exercises by tilting the ankles, without rotating the body, evenly in all directions in the manner of the movement of a pestle in a mortar, thereby moving the legs evenly in all directions.

SUMMARY OF THE INVENTION

In order to eliminate the above-mentioned problems, the object of the present invention is to realize strengthening of the legs and activation of the central nervous system by tilting the ankles evenly in all directions without rotating the body. The above-mentioned object of the present invention was (able to) be achieved by providing on an incline a rocking plate that tilts accompanying the rotation of a rotating disk on the inclined surface of the rotating disk, installing the horizontal surface of the rotating disk by means of a rotation centering member provided on the upper surface of a hollow stand case containing a motor while allowing the rotating disk having a horizontal surface and inclined surface to be rotated by the rotating force of the motor. A central portion of the rocking plate to the upper portion of a universal joint provided upright on the stand case to prevent the rocking plate from rotating.

First, a rotating ring can be rotated by the rotating force of a motor by means of a rotation centering member composed of the combination of a ring-shaped rail and grooved pulley installed on the upper surface of a hollow stand case containing the built-in motor.

By then fixing the center of the rocking plate, which tilts by means of rollers and a lubricating layer and so forth along the upper rotating inclined surface of this rotating ring, on the upper portion of a universal joint provided upright on the stand case, the rocking plate can be tilted evenly in all directions. In other words, since the rocking plate is secured to the universal joint provided upright on a stand case, it is able to rock in all directions without rotating while also not inadvertently coming off or moving vertically.

BRIEF DESCRIPTION OF THE DRAWINGS

FIG. 16(*b*) is a side schematic view showing the operation of another example of the present invention.

DESCRIPTION OF THE PREFERRED EMBODIMENT

First, an explanation of the basic form of the present invention is provided according to FIGS. 1–8.

Figure 1:
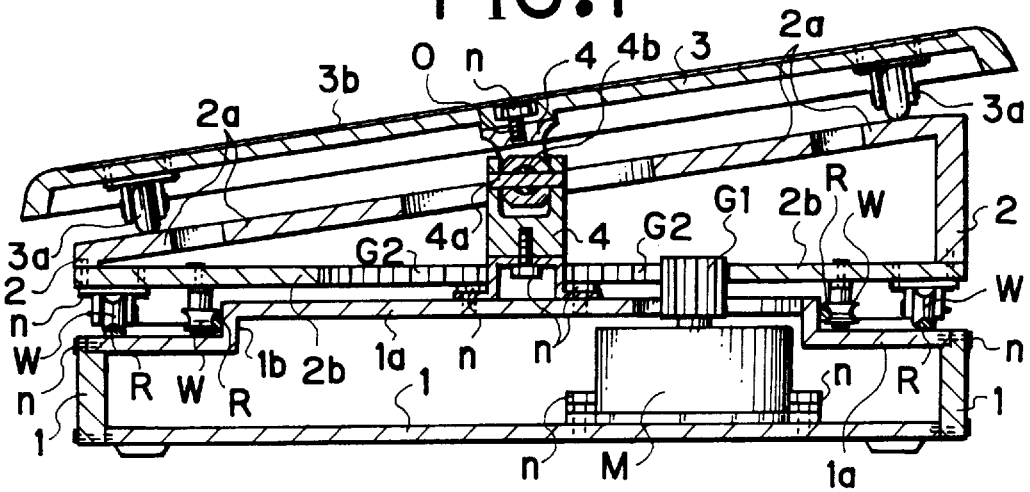
FIG. 1 is a central cross-sectional view of an embodiment of the present invention.
Figure 2:
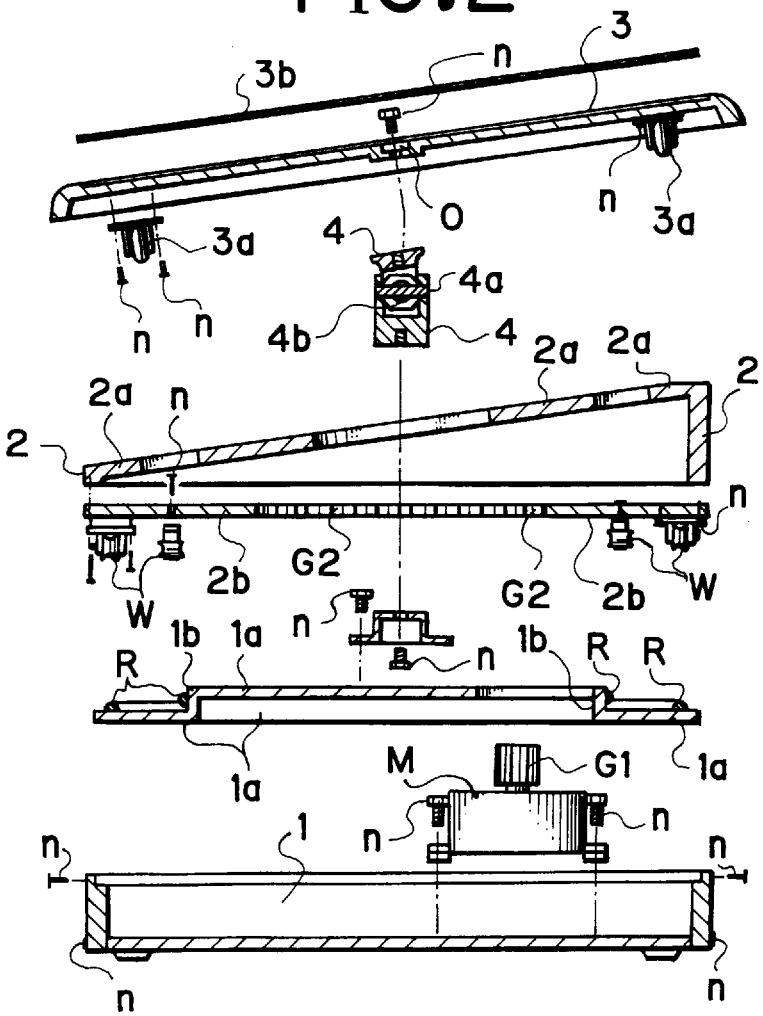
FIG. 2 is an exploded cross-sectional view of the above.

First, as shown in FIGS. 1 and 2, the basic constitution of the present invention consists of providing 2 rotating disk 2, that is rotated by internal gear G2 formed on lower surface plate 2*b* of disk 2, which meshes with gear G1 of motor M. A rotation centering member RW includes grooved pulleys W that engage and roll over a plurality of ring-shaped rails R installed on upper surface 1*a* of hollow stand case 1 containing the built-in motor M. Which that operates at a rotating speed of about 600 rpm.

In addition, rocking plate 3 provided on an incline is equipped with rollers 3*a* on its lower surface that roll over inclined upper surface 2*a* of rotating disk 2, and tilts accompanying rotation of the rotating disk 2.

Figure 3:
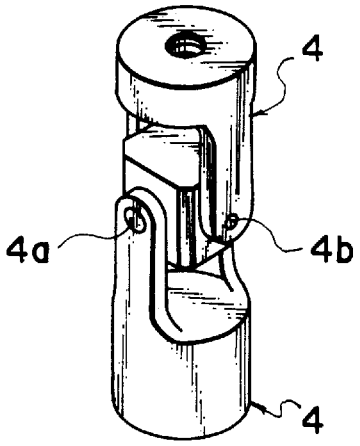
FIG. 3 is a perspective view showing an example of a universal joint.

The rocking foot exerciser according to the present invention is then composed by fixing its central portion O as shown in FIG. 1 on the upper portion of commonly known universal joint 4 having X-Y pivots 4*a* and 4*b* as shown in FIG. 3 provided upright by fixing its lower portion on the stand case 1.

In each of the above-mentioned drawings, reference numerals n all refer to set screws. In addition, three rollers 3*a* are provided on the lower surface of rocking plate 3 at 120° intervals, and although vulcanized rubber should be baked onto the surfaces of these rollers 3*a*, instead of these rollers 3*a*, rocking plate 3 may be arranged overlapping the above-mentioned inclining upper surface 2*a* by means of sliding devices that utilize the lubrication of an oil film or silicon lubricated layer.

Moreover, each member is mechanically strong and rugged, and after sturdily assembling these members as shown in FIG. 1 with set screws n from the state shown in the exploded cross-sectional view shown in FIG. 2, paint-lock is applied to set screws n, and the gear ratio of each gear G1 and G2 is set to roughly 1:10. The installation locations of the above-mentioned rails R and grooved pulleys W may be mutually interchanged. In addition, rubber sheet 3*b* may be placed flat on rocking plate 3, and three rollers 3*a* may be arranged at 120° intervals on inclined upper surface 2*a* of rotating disk 2. An explanation of the operation of the invention will be provided with reference to the drawings.

Rotating disk 2 can be rotated at a low speed of about 1 revolution per second by internal tooth gear G2 of lower surface plate 2*b* of the above-mentioned rotating disk 2, which that meshes with year G1 of the output shaft of motor M by the rotating force of the motor M on horizontal upper surface 1*a* of stand case 1.

As previously described, the centering of this rotation can be achieved by employing a rotation centering means that is free of a center pivot as a result of, for example, mounting ring-shaped rails R in the shape of flat circles on the outer peripheral portion of stand case upper surface 1*a* and the outer peripheral surface of protruding ring portion 1*b* as shown in FIG. 1, and supporting at least three grooved pulleys W to individually engage with the rails R at equal intervals on lower surface plate 2*b* of the rotating disk 2 as shown in FIG. 1.

Figure 4:
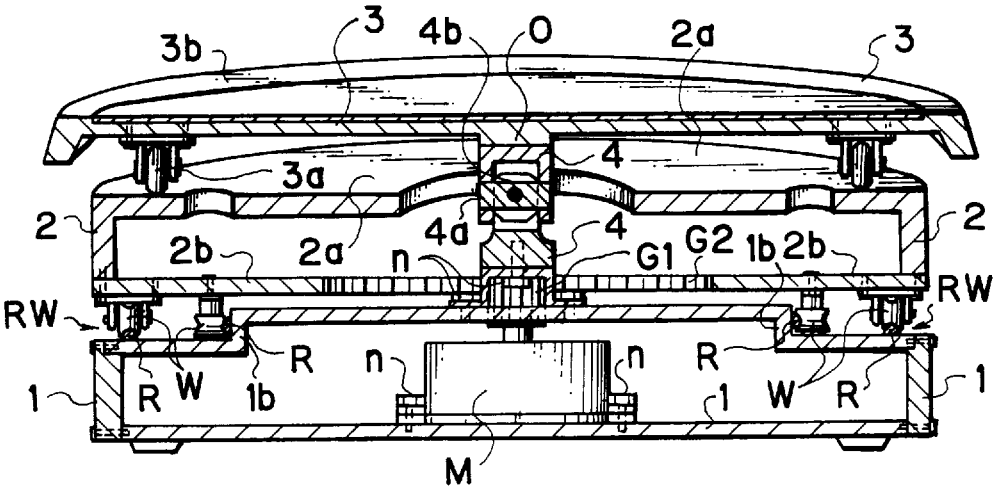
FIG. 4 is a cross-sectional view of a different state from that shown in FIG. 1.
Figure 5:
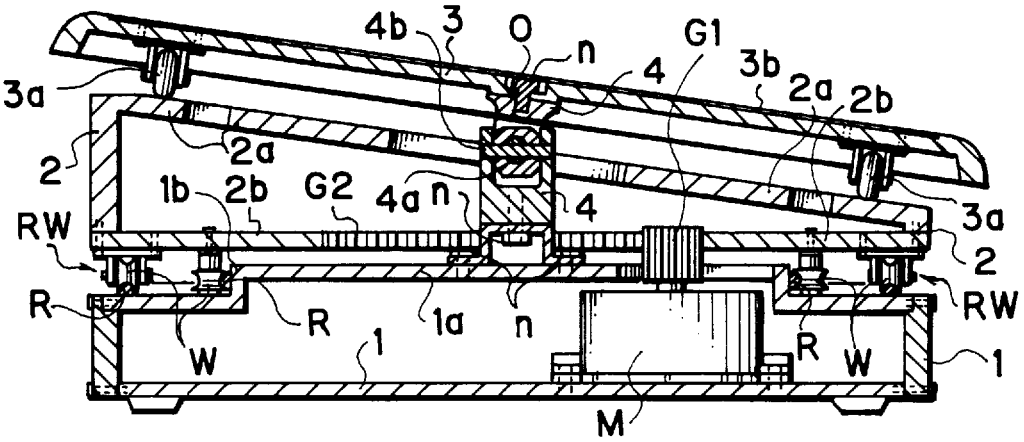
FIG. 5 is a cross-sectional view of a different state from that in FIG. 4.
Figure 6:
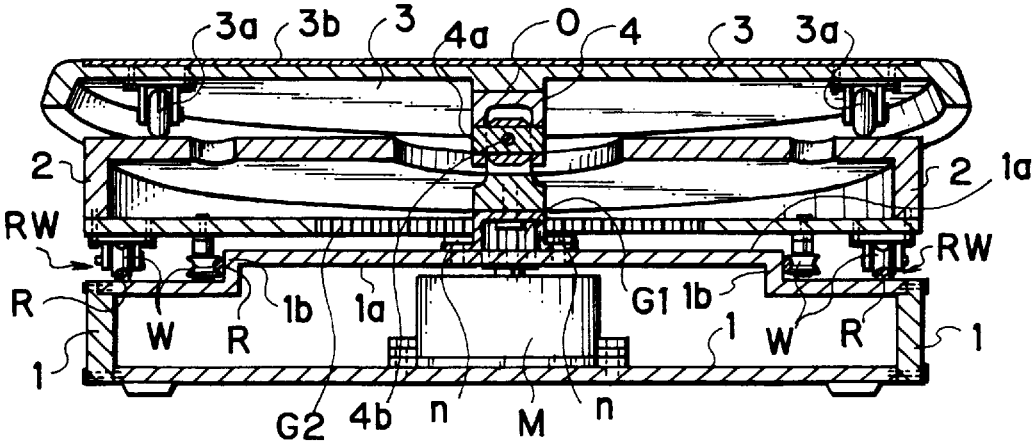
FIG. 6 is a cross-sectional view of a different state from that in FIG. 5.

When viewing from the front, after proceeding from the state rising to the right shown in FIG. 1 to the state lowering to the right shown in FIG. 5 after going through the state lowering to the front shown in FIG. 4 by means of rollers 3*a* of its lower surface and a lubricating layer, accompanying the low-speed rotation of the above-mentioned rotating disk 2, rocking plate 3 above it proceeds from the state lowering to the back shown in FIG. 6 to the state rising to the right of FIG. 1, sequentially repeating tilting in all directions.

As a result of the above-mentioned tilting of rotating disk 2 in all directions, since rocking plate 3 above it is fixed to the upper portion of universal joint 4 at its center O as previously described, in addition to it being possible to block rotation and enable rocking plate 3 to rock on in incline while following the tilting of rotating disk 2 in all directions, the center is not inadvertently shifted, and rocking plate 3 does not inadvertently move up or down.

Figure 7:
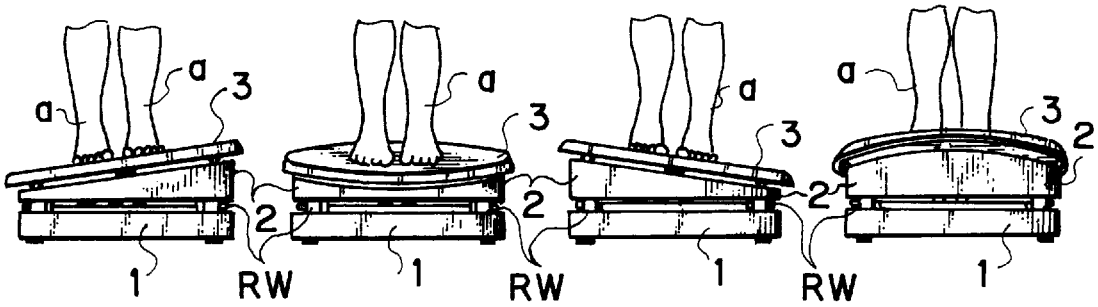
FIG. 7 is a front schematic view showing the operation of the present invention.
Figure 8:
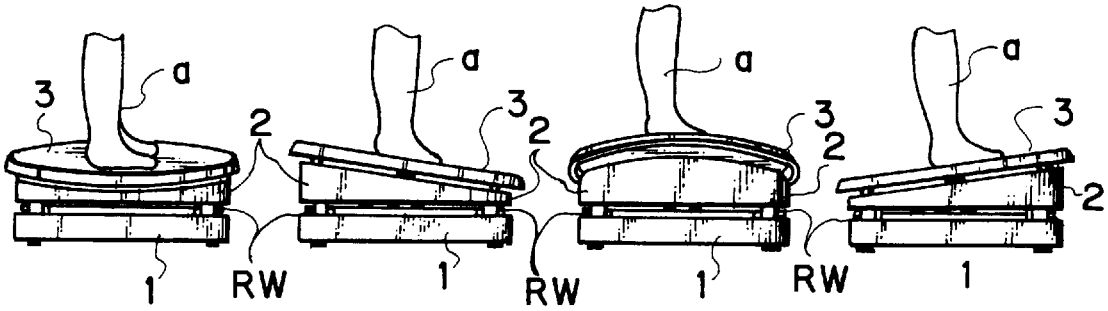
FIG. 8 is a side schematic view showing the operation of the present invention.

Thus, when viewing ankles a of an exercising person placed on rocking plate 3 from the front, as shown viewing from the front in FIG. 7 or viewing from the side in FIG. 8, the ankles can be inclined in all directions in the manner of the movement of a pestle in a mortar, thereby promoting strengthening of the legs and activation of the central nervous system.

The following indicates a variation of the manner of installing the above-mentioned rotating disk 2 and rocking plate 3 of the present invention.

A rotary disk can be rotated by the rotating force of a motor by means of a shaftless centering member installed on the upper surface of a hollow stand case containing the motor.

By then fixing the central portion of a rocking plate that rocks along the rotating inclined upper surface of this rotating disk on the upper portion of a rotating blocking member such as a universal joint or thick spring provided upright on the stand case, the rocking plate is not inadvertently removed and can be tilted evenly in all directions in the manner of the movement of a pestle in a mortar without rotating.

The following provides a description of an embodiment of the above-mentioned variation.

Figure 9A:
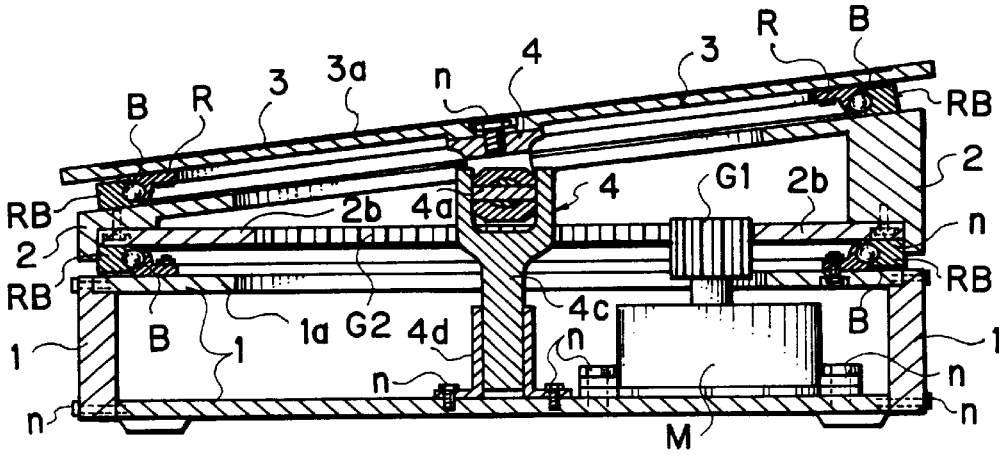
FIGS. 9A and 9B are a cross-sectional views showing the essential portion of another embodiment of the rotation blocking member used in the present invention.
Figure 10A:
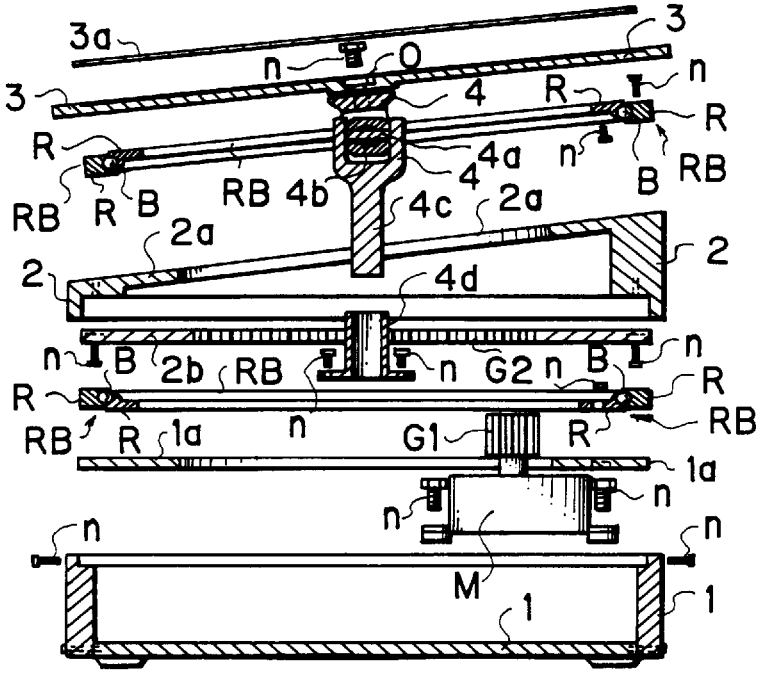
FIGS. 10A and 10B are an exploded cross-sectional views of the above.

First, as shown in FIGS. 9A and 10A, the constitution of the present invention consists of providing shaftless rotating centering member RB, composed of a large number of bearing balls B rolling between each side groove of two large and small flat rings R, on upper surface 1*a* of hollow stand case 1 containing motor M operating at a rotating speed of about 600 rpm.

Together with providing rotating disk 2 flat on this centering member RB while being able to be rotated by the rotating force of internal tooth gear G2 that meshes with output gear G1 of the above-mentioned motor M, rocking plate 3, which tilts on inclined upper surface 2*a* of this rotating disk 2 accompanying its rotation, is concentrically provided on an incline between the above-mentioned centering member and a similar rotation centering member RB.

Figure 11A:
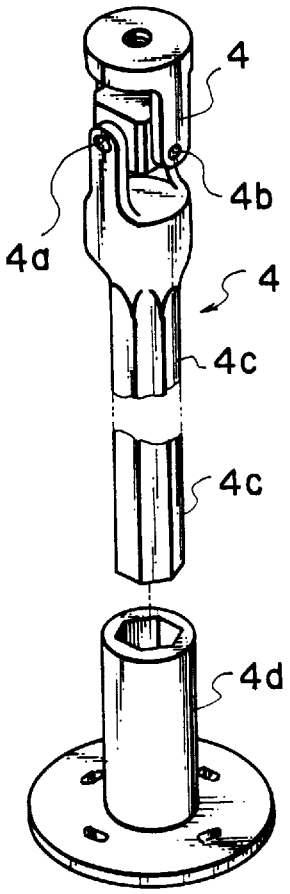
FIGS. 11A and 11B are examples of a universal joint.

In addition, hexagonal column 4*c* of a commonly known universal joint 4, having X-Y pivots 4*a* and 4*b* as shown in FIG. 11 A and mounted extending vertically downward from the inner surface of its central portion O, is inserted deeply into hexagonal socket pipe 4*d* provided upright on the upper surface of the stand case 1 as shown in FIG. 9A, thereby composing a rocking foot exerciser according to the present invention containing an example of a member that prevents rotation of the rocking plate 3.

Next, as an actual example of the above-mentioned shaftless rotation centering member RB, by using a large number of bearing balls in the manner of steel balls that are inserted through ball insertion holes in the outside of a large ring while allowing the bearing balls to roll between each side groove of two large and small flat rings R as shown in FIG. 10A, which were made by die-cast forming from a metal such as aluminum, a commonly known rotating centering member is used that was made by joining each of the above-mentioned rings.

Furthermore, together with plugging the above-mentioned ball insertion holes of each rotating centering member RB with male screws after inserting the balls, upper and lower flat rings R are securely fixed to adjacent stand case upper surface 1A, rotating disk 2, rotating disk upper surface 2 and rocking plate 3 with a fixing means such as by bolting or adhering, enabling the rings R to be made reliably.

Although this shaftless rotating centering member RB can be used in an ordinary television stand turntable and similar applications, since this centering member RB fits loosely by means of the above-mentioned large number (roughly 50–100) of bearing balls B positioned between the side grooves of large and small metal rings R, it is rugged and rotates smoothly, and is not inadvertently moved up and down or shifted off center.

The following provides an explanation of the operation of the embodiment described above.

Rotating disk 2 can be rotated at a low speed of about 1 revolution per second by internal tooth gear G2 of lower surface plate 2*b* of the above-mentioned rotating disk 2, which meshes with gear G1 of the output shaft of motor M by the rotating force of the motor M on horizontal upper surface 1*a* of stand case 1.

As previously described, the centering of this rotation can be achieved by employing a commonly known rotation centering means according to shaftless rotation centering member RB.

When viewing from the front, after proceeding from the state rising to the right shown in FIG. 1 to the state lowering to the right shown in FIG. 5 after going through the state lowering to the front shown in FIG. 4 by means of the above-mentioned shaftless rotating centering member RB provided in a row on the lower surface of rocking plate 3 due to the low-speed rotation of the above-mentioned rotating disk 2, the rocking plate 3 above it proceeds from the state lowering to the back shown in FIG. 6 to the state rising to the right of FIG. 1, sequentially repeating tilting in all directions.

During this operation, since rocking plate 3 above rotating disk 2 is fixed to the upper portion of universal joint 4 at its center O as previously described, in addition to it being possible to prevent rotation and enable rocking plate 3 to rock on an incline while following the tilting of the upper surface of rotating disk 2 in all directions without rotating, the center is not inadvertently shifted, and rocking plate 3 does not inadvertently move up or down.

Thus, when viewing ankles a of an exercising person placed on rocking plate 3 from the front, as shown viewing from the front in FIG. 7*a* or viewing from the side in FIG. 7*b*, the ankles can be inclined in all directions in the manner of the movement of a pestle in a mortar without rotating, thereby promoting strengthening of the legs and activation of the central nervous system.

Figure 12:
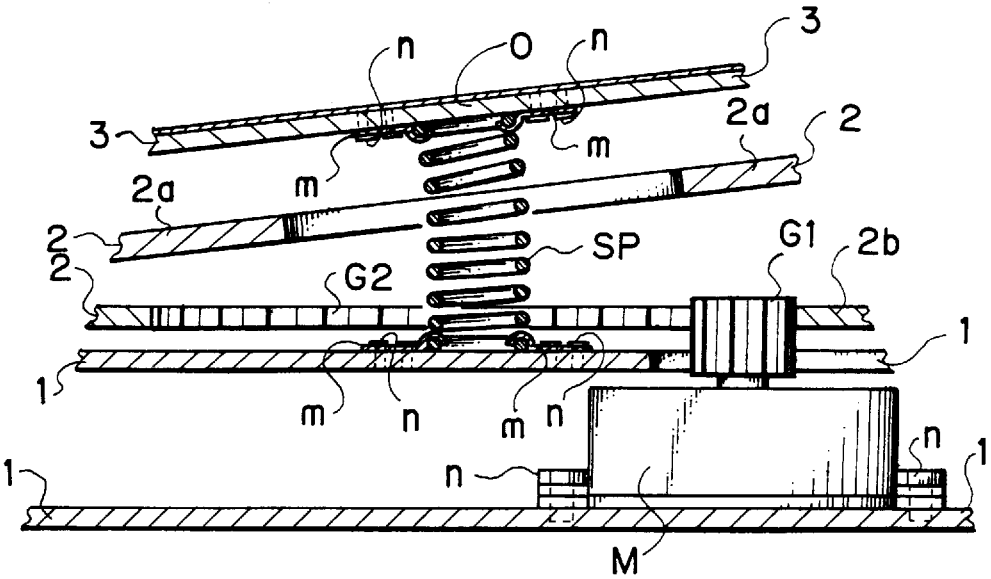
FIG. 12 is a cross-sectional view showing the essential portion of another embodiment of the rotation blocking member used in the present invention.
Figure 13:
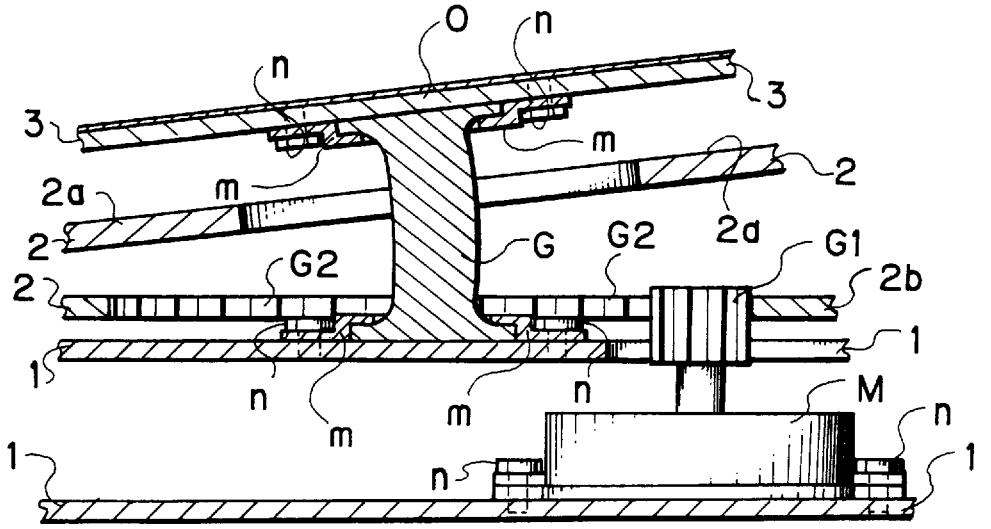
FIG. 13 is a cross-sectional view showing the essential portion of another embodiment of the rotation blocking member used in the present invention.

Furthermore, as in alternative to universal joint 4 of the previous example used for the member that blocks rotation of rocking plate 3, for example, rugged coil spring SP that is flexurally deformed by an external force as shown in FIG. 12, or a rugged resilient body such as semi-hard, synthetic rubber column G as shown in FIG. 13, can be used by attaching with mounting seats m and set screws n.

Figure 14:
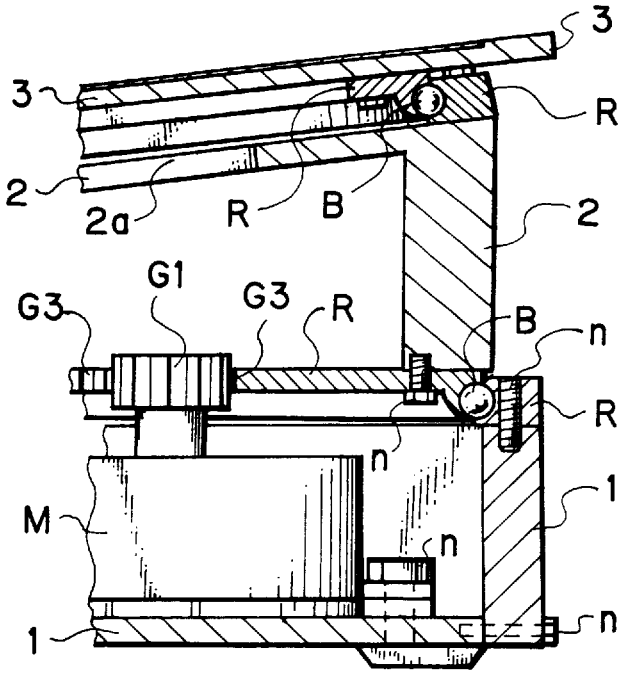
FIG. 14 is a cross-sectional view showing the essential portion of another example of the present invention wherein internal teeth are formed on the rotating center member used in the present invention.

In addition, internal tooth gears G3 on the small radius side of flat ring R fixed on the lower portion of rotating disk 2 as shown in FIG. 14 can be used for internal tooth gear G2 of the rotating disk 2.

In each of the above-mentioned drawings, those reference numerals that are identical to those of the above-mentioned embodiments indicate identical or equivalent portions.

Next, the following describes variations in the manner which the universal joint of the present invention is fixed eccentrically.

Figure 9B:
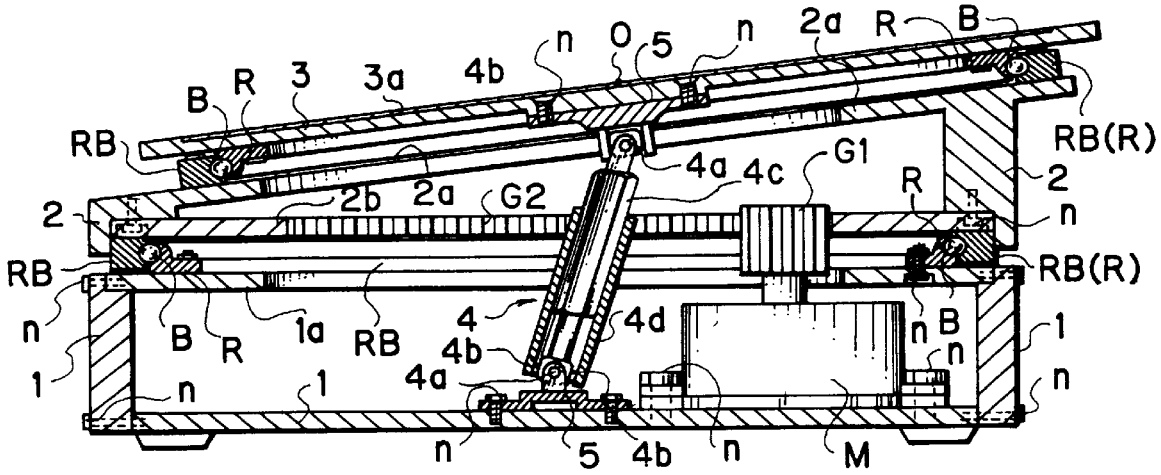
Figure 10B:
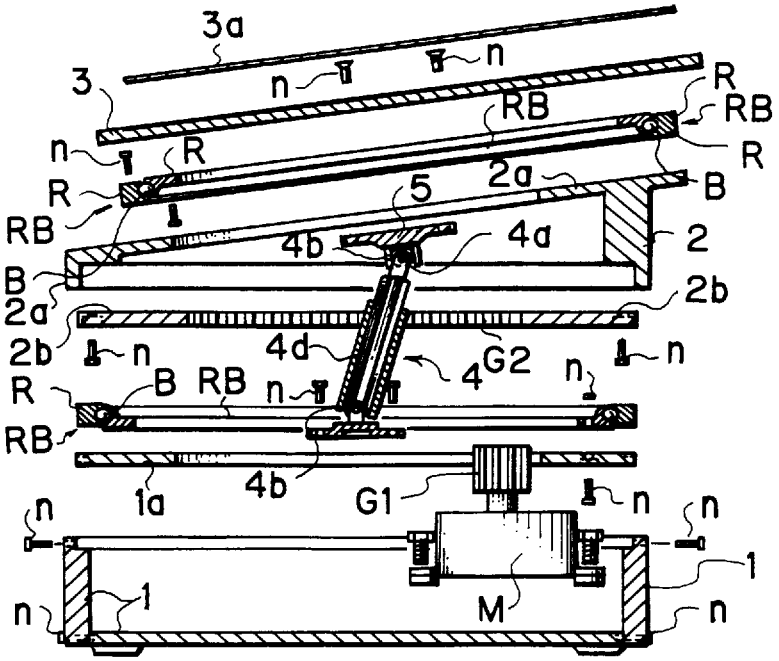

As shown in FIGS. 9B and 10B, the invention consists of flatly providing shaftless, flat rotating centering member RB, composed of a large number of small bearing balls B rolling between each opposing side groove of two large and small flat rings R, on upper surface 1*a* of hollow stand case 1 containing motor M operating at a rotating speed of about 600 rpm, by fixing inside ring R.

Together with flatly providing rotating disk 2 on outer ring R of this centering member RB while being able to be rotated by the rotating force of internal tooth gear G2, which meshes with output gear G1 of the above-mentioned motor M, rocking plate 3, which is positioned eccentrically to the center of rotation of rotating disk 2 on inclined upper surface 2*a* of the rotating disk 2, is fixed on an incline to inner ring R of rotation centering member RB by arranging and fixing a shaftless, rotation centering member RB similar to the above-mentioned rotation centering member with outer ring R.

Figure 11B:
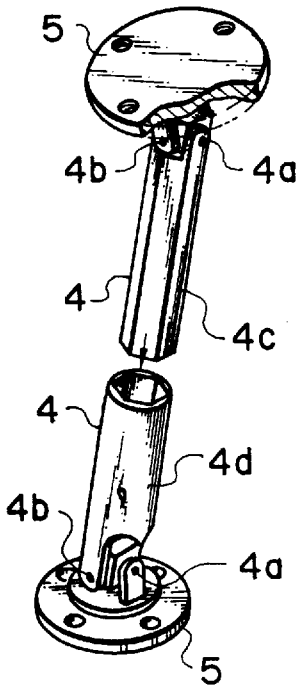

In addition, hexagonal column 4*c*, formed following X-Y pivots 4*a* and 4*b* of the upper portion of a commonly known overlapping universal joint 4 having one each of X-Y pivots 4*a* and 4*b* above and below as shown in FIG. 11B and mounted extending vertically downward by bolting with mounting seats 5 to the inner surface in the vicinity of central portion O of rocking plate 3, is inserted deeply into hexagonal socket pipe 4*d* provided upright by means of X-Y pivots 4*a* and 4*b* fixed with mounting seats 5 to the upper surface of the stand case 1 as shown in FIG. 9B, thereby composing a rocking foot exerciser according to the present invention containing an example of rotation blocking member that prevents rotation of the rocking plate 3 while flexurally deforming.

The following provides an explanation of its operation. Rotating disk 2 can be rotated at a low speed of revolution per second by internal tooth gear G2 of lower surface plate 2*b* of the above-mentioned rotating disk 2, which meshes with gear G1 of the output shaft of motor M by the rotating force of the motor M on horizontal upper surface 1*a* of stand case 1.

As previously described, the centering of this rotation can be achieved by employing a commonly known rotation centering means according to flat, shaftless rotation centering member RB. When viewing from the front, after proceeding from the state shifted to the right and rising to the right shown in FIG. 9B to the state shifted to the left and lowering to the right after going through the state shifted to the back and lowering to the front by means of the above-mentioned shaftless rotating centering member RB provided in a row on the lower surface of rocking plate 3 due to the low-speed rotation of the above-mentioned rotating disk 2, the rocking plate 3 above it proceeds from the state shifted to the front and lowering to the back to the state shifted to the right and rising to the right of FIG. 9B, sequentially tilting in all directions while repeating eccentric movement.

During this operation, since rocking plate 3 above rotating disk 2 is fixed to the upper portion of overlapping universal joint 4 in the vicinity of center O as previously described, in addition to it being possible to prevent rotation and enable rocking plate 3 to eccentrically rock on an incline while following the tilting of the upper surface of rotating disk 2 in all directions and moving eccentrically in all directions without rotating, the degree of this eccentric rocking is not inadvertently shifted, and rocking plate 3 does not inadvertently move up or down.

Figure 15:
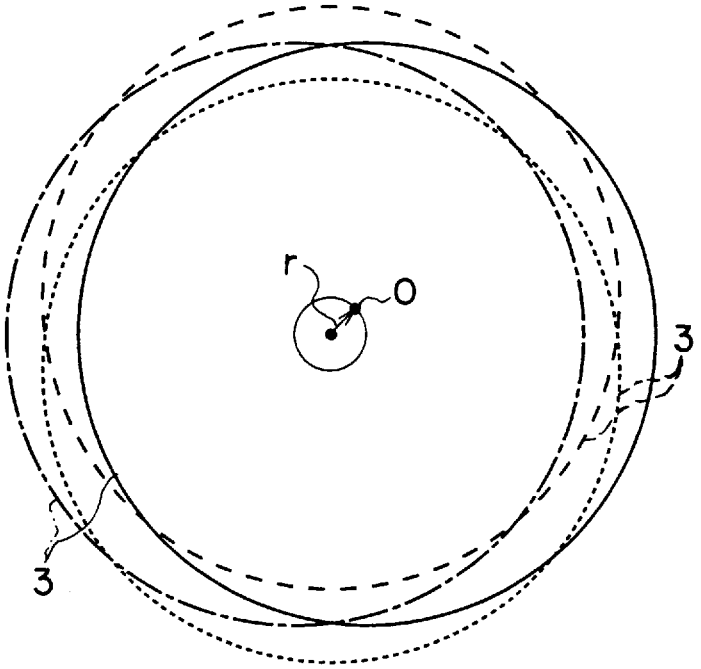
FIG. 15 is an eccentric circle about center O of the rocking plate.
Figure 16A:
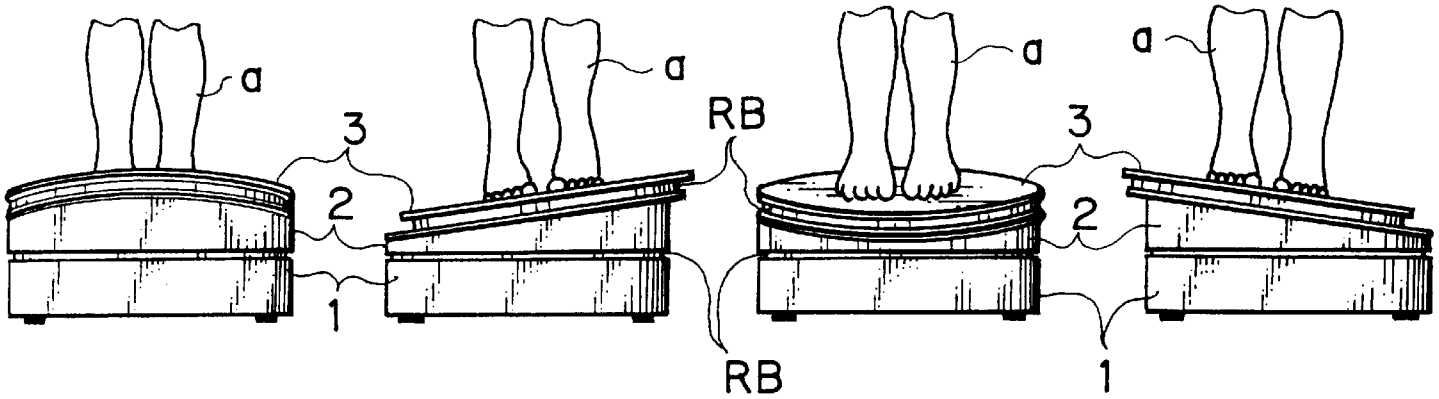
FIG. 16(*a*) is a front schematic view showing the operation of another example of the present invention.
Figure 16B:
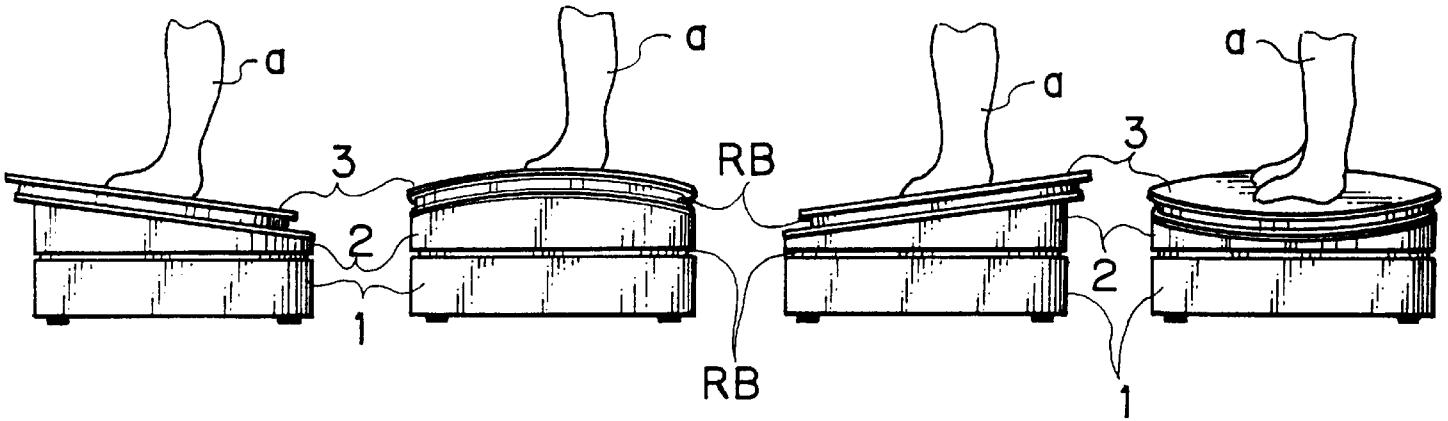

Thus, when viewing ankles a of an exercising person placed on rocking plate 3 from the front, as shown viewing from the front in FIG. 16*a* or viewing from the side in FIG. 16*b*, the ankles can be moved eccentrically while inclining in all directions along the path of an eccentric circle about center O of rocking plate 3 according to eccentric radius r shown in FIG. 15 in a single plane without rotating in the manner of the movement of a pestle in a mortar, thereby promoting strengthening of the legs and activation of the central nervous system.

Effects of the Invention

As a result of having the constitution as described above, the present invention offers the advantages indicated below. Since rocking plate 3 on inclined upper surface 2*a* of rotating disk 2 that rotates on stand case 1 is fixed to the upper portion of universal joint 4 at its center O, in addition to it being able to be rocked on an incline smoothly by following the tilting of inclined upper surface 2*a* of rotating disk 2 without rotating, the center is not inadvertently shifted out of position and rocking plate 3 does not move up and down, thereby enabling the present invention to offer the advantage of enabling an exercising person to safely strengthen his or her ankles and exercise his or her legs on rocking plate 3 as well as promote activation of the central nervous system.

The invention offers the advantages indicated below.

Since inclined rocking plate 3, positioned on a shaftless rotation centering member RB arranged eccentrically on inclined upper surface 2*a* of rotating disk 2, which rotates on stand case 1, is fixed to the upper portion of a rotation blocking member that is able to bend freely, such as overlapping universal joint 4, in the vicinity of its center O, in addition to it being able to be smoothly rocked on an incline in all directions as well as move eccentrically in a non-rotating state by following the eccentric inclination of a rotation centering member on inclined upper surface 2*a* of rotating disk 2 without rotating, the degree of this eccentric rocking is not inadvertently changed and rocking plate 3 does not inadvertently move up and down, thereby enabling the present invention to offer the advantage of enabling an exercising person to eccentrically rock his or her feet while inclining in all directions safely, thereby being able to strengthen his or her ankles and exercise his or her legs as well as promote activation of the central nervous system.

I claim:

1. A foot rocker comprising:

a stand case housing a motor and a universal joint;

a rotating disk attached to said stand case at a center thereof and being driven by said motor for rotation about said center relative to said stand case via a first bearing, said rotating disk comprising a flat lower surface plate facing said stand case and an inclined upper surface; and a rocking plate attached to said universal joint and disposed on said inclined upper surface and positioned eccentrically relative to a center of said inclined upper surface of said rotating disk, said rotating disk rotating relative to said rocking plate via a second bearing whereby upon rotation of said rotating disk said rocking plate moves in a rocking and eccentrically orbital fashion relative to said stand case, wherein at least one of said first bearing and said second bearing comprises a ring-shaped rail oriented in a plane substantially parallel to said flat lower surface plate and a rolling member concentrically engaged with said ring-shaped rail for movement about said rail in said plane.

2. A foot rocker according to claim 1, wherein said rolling member comprises a pulley.

3. A foot rocker according to claim 1, wherein said rolling member comprises a plurality of bearing balls.

4. A foot rocker according to claim 1, wherein said universal joint comprises a first universal joint secured to said stand case, a support shaft secured at one end to said first universal joint and extending through said flat lower surface plate, and a second universal joint secured to an other end of said support shaft, said rocking plate being secured to said second universal joint.

5. A foot rocker according to claim 4, wherein said support shaft extends at an angle from said stand case through said flat lower surface plate.

6. A foot rocker according to claim 1, wherein said universal joint is an overlapping universal joint.

7. A foot rocker according to claim 1, wherein said universal joint comprises a spring.

8. A foot rocker comprising:

a stand case housing a motor and a universal joint;

a rotating disk attached to said stand case at a center thereof and being driven by said motor for rotation about said center relative to said stand case, said rotating disk comprising a flat lower surface plate facing said stand case and an inclined upper surface; and a rocking plate attached to said universal joint and disposed on said inclined upper surface, said rotating disk rotating relative to said rocking plate via a bearing, wherein said rocking plate is positioned eccentrically relative to a center of said inclined upper surface of said rotating disk whereby upon rotation of said rotating disk said rocking plate moves in a rocking and eccentrically orbital fashion relative to said stand case.

9. A foot rocker according to claim 8, wherein said universal joint comprises a first universal joint secured to said stand case, a support shaft secured at one end to said first universal joint and extending through said flat lower surface plate, and a second universal joint secured to an other end of said support shaft, said rocking plate being secured to said second universal joint.

10. A foot rocker according to claim 9, wherein said support shaft extends at an angle from said stand case through said flat lower surface plate.

11. A foot rocker according to claim 8, wherein said universal joint is an overlapping universal joint.

* * * * *